United States Patent [19]

Louthan et al.

[11] Patent Number: 4,659,490

[45] Date of Patent: Apr. 21, 1987

[54] AQUEOUS METAL-WORKING COMPOSITION AND PROCESS

[75] Inventors: Rector P. Louthan; Merlin R. Lindstrom; Bernard A. Baldwin, all of Bartlesville, Okla.; Gary D. Macdonell, Louisville, Ky.

[73] Assignee: Phillips Petroleum Company, Bartlesville, Okla.

[21] Appl. No.: 791,027

[22] Filed: Oct. 24, 1985

[51] Int. Cl.[4] ..... C10M 173/00

[52] U.S. Cl. ..... 252/47.5; 252/49.3; 252/51.5 R

[58] Field of Search ..... 252/49.3, 51.5 R, 47.5

[56] References Cited

U.S. PATENT DOCUMENTS

| | | | |
|---|---|---|---|
| 2,491,772 | 12/1949 | Rudel | 252/47.5 |
| 2,691,000 | 10/1954 | Elliott | 252/47.5 |
| 3,278,526 | 10/1966 | Louthan et al. | 260/239.3 |
| 3,376,322 | 4/1968 | Thompson | 252/47.5 |
| 3,525,737 | 8/1970 | Kern et al. | 260/239.3 |
| 3,741,834 | 6/1973 | Williams et al. | 252/542 |
| 4,250,046 | 2/1981 | Przybylinski | 252/49.3 |
| 4,257,902 | 3/1981 | Singer | 252/18 |

OTHER PUBLICATIONS

Smalheer and Smith, "Lubricant Additives", 1967, pp. 9–11.

*Primary Examiner*—William R. Dixon, Jr.
*Assistant Examiner*—Ellen M. McAvoy
*Attorney, Agent, or Firm*—Mark A. Montgomery

[57] ABSTRACT

Novel metal-working process and aqueous metal-working fluids are provided. The aqueous metal-working fluids contain at least one N,N'-dilactam disulfide as an extreme pressure (EP) additive.

17 Claims, No Drawings

AQUEOUS METAL-WORKING COMPOSITION AND PROCESS

BACKGROUND OF THE INVENTION

This invention relates to improved aqueous metal-working compositions. This invention also relates to methods of treating metal surfaces that are to be worked. In one aspect, this invention relates to extreme pressure (EP) additives for aqueous metal-working compositions. In yet another aspect this invention relates to methods for enhancing aqueous metal-working compositions.

Metal-working compositions such as used in grinding, machining and cutting require good extreme pressure (EP) lubricating properties. Since the base fluids generally have little EP character, this property is provided by the use of additives.

Other important characteristics of metal-working compositions are provided by other additives so that, typically, the composition will contain small amounts of at least one of EP lubricating additive, pH buffer additive, corrosion (rust) inhibitor, surfactant, and biocide among others. Among the components that make up a metal-working composition it is the extreme pressure agent that provides the composition with the definite character of a lubricant for cutting, grinding or machining metal. The present invention provides an EP agent that is effective and compatible with other commonly used components.

It is, therefore, an object of this invention to provide a metal-working composition containing an effective extreme pressure lubricating agent. It is another object of this invention to provide a method for enhancing extreme pressure lubricating properties of a metal-working composition by the addition of a specific additive.

Other objects, aspects, as well as the several advantages of the invention will be apparent to those skilled in the art upon reading the specification and the appended claims.

SUMMARY OF THE INVENTON

In accordance with the invention an aqueous metal-working composition is provided containing at least one N,N'-dilactam-disulfide.

In accordance with another embodiment of the invention, a method is provided for enhancing the extreme pressure lubricating properties of an aqueous metal-working composition by admixing therein an effective amount of at least one N,N'-dilactam-disulfide.

In accordance with still another embodiment of the invention, a method is provided for the treatment of metal surfaces with aqueous metal-working fluids containing at least one N,N'-dilactam-disulfide.

In its broadest aspect the invention provides an effective metal-working composition, a method for improving the effectiveness of metal-working compositions and a method for the treatment of metal surfaces.

DESCRIPTION OF SPECIFIC EMBODIMENT

The N,N'-dilactam-disulfides useful as additives in the present invention can be prepared according to U.S. Pat. No. 3,525,737, by reacting a lactam which has a free hydrogen atom or a metal atom directly attached to the nitrogen atom, with disulfur dichloride, also called sulfur monochloride. Certain dilactam disulfides can also be prepared as described in U.S. Pat. No. 3,278,526, whereby a substituted alkylmercaptan is added in the presence of U.V. light and a catalyst across the double bond of an N-vinyl-substituted pyrrolidone or succinimide to give as a major product the corresponding mercaptan adduct with lesser amounts of coupled products the respective sulfides and disulfides, etc. U.S. Pat. No. 3,525,737 and U.S. Pat. No. 3,278,526 are incorporated herein by reference. The N,N'-dilactam-disulfide compounds particularly useful within the context of this invention can be represented by the generalized formula:

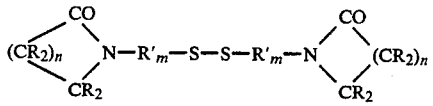

wherein m is 0 or 1, n is an integer between one and ten, both inclusive, R is the same or different and is selected from hydrogen and alkyl groups having from 1 to 6 carbon atoms, and where R' is the same or different and is selected from alkyl groups having from 1 to 18 carbon atoms.

Examples of compounds useful in the present invention are:

bis(2-[N-2-pyrrolidonyl]ethyl)disulfide
bis(2-[N-2-pyrrolidonyl]propyl)disulfide
bis(3-[N-2-pyrrolidonyl]propyl)disulfide
2-(N-2-pyrrolidonyl)ethyl-(N-2-pyrrolidonylmethyl)disulfide and the like and mixtures thereof.

N,N'-dilactam-disulfide is effectively used as an extreme pressure agent in metal working compositions in relatively small amounts. Any amount of additive that is sufficient to increase extreme pressure or load bearing properties to the metal-working composition is considered useful for this invention.

The metal-working compositions are best prepared as concentrate containing an effective amount up to about 15 weight percent, preferably from about 5 to about 10 weight percent of the additive in an aqueous medium. In actual use the concentrate is diluted with additional water in an amount and a range of about 5:1 to about 40:1 of water to concentrate depending upon the type of metal work in which the composition is being used. The concentration of the EP additive in the final metal-working composition will be in the range of about 0.1 to about 3.0 weight percent.

The metal-working composition will typically contain effective amounts of compounds useful for increasing lubricity, adjusting pH, inhibiting corrosion, acting as biocide, acting as surfactant or to give other useful properties to the composition. When these components are present in the concentrated composition an effective amount will generally fall within the range of about 5 to about 10 weight percent lubricity additive, about 0.5 to about 10 weight percent pH adjusting compound, about 1 to about 5 weight percent corrosion inhibitor, and about 0.10 to about one weight percent biocide.

Note that upon dilution of the concentrated metal-working composition that a preferred range of additive concentration will follow the range of about 0.1–3.0 weight percent for the EP additive of this invention, about 0.1–2.0 weight percent for lubricity additive, about 0.01–2.0 weight percent for pH adjusting compound, about 0.02–1.0 weight percent for corrosion inhibitor and about 0.002–0.2 weight percent for biocide.

In addition to these other additives the metal working fluid can also contain a surfactant. Preferably the surfactant is in the range of about 0.1 to about 2.0 weight percent based on the total working fluid.

The most preferred concentration of additives in weight percent is at least about 0.1 for corrosion inhibitor, 0.05 for pH adjusting compound and 0.5 for lubricity additive.

The preparation of the compositions of this invention is by the admixing of additives in aqueous solution in any order of additives required for a particular purpose. All components are water soluble and, in fact, aside from the EP additive of this invention, other components of the metal-working composition can be chosen from any of the compounds well-known in the art to be useful and effective for providing specific, desirable properties to the metal-working composition. The specific choice of other components of the composition is not critical to the present invention.

The aqueous compositions of the present invention can be used in methods for shaping metal with a working tool by lubricating the tool and/or the metal. These shaping processes comprise cutting, grinding, drilling, punching, stamping, turning, lapping, polishing, rolling, drawing, and combinations of said processes. The metal piece can comprise at least one ferrous or at least one non-ferrous metal or a combination of both.

The effectiveness of the herein-described N,N'-dilactam-disulfide containing aqueous metal working fluids is demonstrated by the following examples. These examples should be taken as illustrative and not as restrictive.

In the following examples a base concentrate of metal-working composition was prepared generally using distilled water and various additives useful for specific purposes. Among the additives used were the following:

bis[2-(N-2-pyrrolidonyl)ethyl]disulfide, one of the extreme pressure agents of this invention, octanoic acid, a corrosion inhibitor available from Aldrich Chemical Co., Milwaukee, Wis., triethanol amine, a pH adjusting compound available from Aldrich Chemical Co., Milwaukee, Wis., polypropylene glycol 400 MW, a lubricity additive available from Polysciences, Inc., Warrington, Pa.

When these specific additives are used, the aqueous metal-working fluid preferably contains at least about 0.1 weight percent octanoic acid, at least about 0.05 weight percent triethanolamine, at least about 0.5 weight percent polypropylene glycol, at least about 0.5 weight percent N,N'-dilactam-disulfide, and at least about 80 weight percent distilled water based on the total composition of the metal working fluid.

EXAMPLE 1

The following illustrate the effectiveness of N,N'-dilactam-dilsufide as an extreme pressure (EP) agent. Aqueous metal-working fluids are compared; a control run with no extreme pressure additives and runs containing different amounts of an extreme pressure additive according to the invention.

The following table lists aqueous metal-working fluids containing 0.150 weight percent octanoic acid, 0.075 weight percent triethanolamine, 0.600 weight percent polypropylene glycol 400 MW, and 0 to 2.0 weight percent invention additive, with the balance being distilled water making the total for each run 100 weight percent. The test used was the well known Falex EP test (ASTM D-3233).

TABLE I

| Run | Additive | Weight Percent Additive | Maximum EP Load (lbs) |
|---|---|---|---|
| 1 (Control) | None | — | 1450 |
| 2 (Inv) | bis[2-(N—2-pyrrolidone) ethyl] disulfide | 0.5 | 2750+ |
| 3 (Inv) | bis[2-(N—2-pyrrolidone) ethyl] disulfide | 2.0 | 2750 |

2750+ indicates that the lubricant did not fail at 2750 lbs. applied load, which is the limit of the instrument.

It can be seen from Table I that the use of the extreme pressure additive of the present invention provided a large increase in the maximum extreme pressure load as compared to the same base metal-working fluid without the extreme pressure additive.

EXAMPLE 2

Many compounds are good EP additives only because they keep the octanoic acid in solution. A second set of tests were done on octanoic acid-free aqueous metal-working fluids. These tests were conducted to see which EP additives had good EP lubricating properties without the influence of dissolved octanoic acid. Other than being octonoic acid free the composition is the same as in Example I, the balance being distilled water.

TABLE II

| Run | Additive | Weight Percent Additive | Maximum EP Load (lbs) |
|---|---|---|---|
| 1 (Inv) | bis[2-(N—2-pyrrolidone) ethyl] disulfide | 0.5 | 750+ |
| 2 (Inv) | bis[2-(N—2-pyrrolidone) ethyl] disulfide | 2.0 | 2000 |
| 3 (Control) | None | — | —* |

*Broke during breakin at a load of less than 250.

As shown in Table II the compounds according to the present invention exhibited good EP lubricating properties in the absence of octonoic acid.

The invention compound of the examples was also tested and found to have good aging qualities and is sulfur active (stains copper), a desirable property for metal working fluids.

The above results show that the addition of N-N'-dilactam-disulfide to aqueous metal-working fluids significantly improves the properties of the fluids.

That which is claimed is:

1. A composition comprising an aqueous metal-working fluid and at least one N,N'-dilactam-disulfide in an amount sufficient to impart extreme pressure lubricating properties to the metal-working fluid wherein the N,N'dilactam-disulfide is represented by the formula:

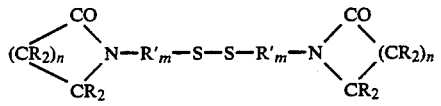

wherein m is 0 or 1, n is an integer between one and ten, both inclusive, R is the same or different and is selected from hydrogen and alkyl groups having 1 to 6 carbon atoms, and wherein R′ is the same or different and is selected from alkyl groups having from 1 to 18 carbon atoms.

2. A composition according to claim 1 wherein the N,N′-dilactam-disulfide is bis[(N-2-pyrrolidonyl)ethyl]-disulfide.

3. A composition according to claim 2 wherein the bis[(N-2-pyrrolidonyl)ethyl]disulfide present ranges from about 0.1 to about 3.0 weight percent based on the total metal-working fluid.

4. A composition of claim 3 wherein the metal-working fluid also contains an effective amount of at least one compound selected from a surfactant, a pH adjusting compound, a corrosion inhibitor and a biocide.

5. A composition of claim 4 wherein the metal working fluid contains a surfactant in the range of at least about 0.1 to about 2.0 weight percent based on the total working fluid.

6. A composition of claim 4 wherein the metal working fluid contains a pH adjusting compound in the range of at least about 0.01 to about 2.00 weight percent based on the total working fluid.

7. A composition of claim 4 wherein the metal working fluid contains a corrosion inhibitor in the range of at least about 0.02 to about 1.00 weight percent based on the total working fluid.

8. A composition of claim 4 wherein the metal working fluid contains a biocide in the range of at least about 0.002 to about 0.2 weight percent based on the total working fluid.

9. A composition according to claim 1 wherein the N,N-dilactam-disulfide is in the range of about 0.1 to about 3.0 weight percent based on the total working fluid.

10. A composition according to claim 9 wherein the aqueous metal-working fluid also contains at least one additional additive selected from a surfactant in the range of about 0.1 to about 2.0, a lubricity additive in the range of about 0.1 to about 2.0, a pH adjusting compound in the range of about 0.01 to about 2.0, a corrosion inhibitor in the range of about 0.02 to about 1.0, and a biocide in the range of about 0.002 to about 0.2.

11. A composition according to claim 10 wherein the aqueous metal-working fluid contains a corrosion inhibitor which is octanoic acid, a pH adjusting compound which is triethanolamine, and a lubricity additive which is polypropylene glycol.

12. A composition according to claim 9 wherein the aqueous metal-working fluid contains at least about 0.1 weight percent octanoic acid, at least about 0.05 weight percent triethanolamine, at least about 0.5 weight percent polypropylene glycol, at least about 0.5 weight percent N,N′-dilactam-disulfide, and at least about 80 weight percent distilled water based on the total composition of the metal working fluid.

13. A composition according to claim 1 wherein the N,N′dilactam-disulfide is:

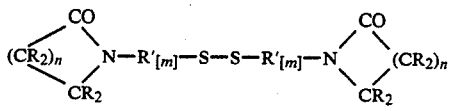

wherein n is an integer between one and ten, both inclusive, R is the same or different and is selected from hydrogen and alkyl groups having 1 to 6 carbon atoms, and wherein R′ is the same or different and is selected from alkyl groups having from 1 to 18 carbon atoms.

14. A composition according to claim 13 wherein the N,N′dilactam-disulfide is bis[(N-2-pyrrolidonyl)ethyl]-disulfide in the range of about 0.5 to about 2.0 weight percent based on the total metal working fluid.

15. A method for enhancing the extreme pressure lubricating properties of an aqueous metal-working composition, said method comprising admixing therein an effective extreme pressure lubricating improving amount of at least one N,N′-dilactam-disulfide represented by the formula:

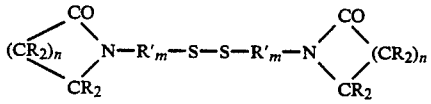

wherein m is 0 or 1, n is an integer between one and ten, both inclusive, R is the same or different and is selected from hydrogen and alkyl groups having 1 to 6 carbon atoms, and wherein R′ is the same or different and is selected from alkyl groups having from 1 to 18 carbon atoms.

16. A method for enhancing the extreme pressure lubricating properties of an aqueous metal-working composition according to claim 15 wherein the N,N′-dilactam-disulfide is bis[(N-2-pyrrolidonyl)ethyl]disulfide in an amount from about 0.5 to about 10 weight percent of the composition.

17. A method in the treatment of metal surfaces with aqueous metal-working fluids during metal cutting, rolling and working operations, comprising applying a sufficient amount of an aqueous fluid according to claim 1 to reduce wear and improve extreme pressure lubrication of the metal.

* * * * *